US010041691B2

(12) United States Patent
Fujita

(10) Patent No.: US 10,041,691 B2
(45) Date of Patent: Aug. 7, 2018

(54) CEILING-EMBEDDED AIR CONDITIONER

(71) Applicant: FUJITSU GENERAL LIMITED, Kawasaki-shi, Kanagawa-ken (JP)

(72) Inventor: Naoto Fujita, Kawasaki (JP)

(73) Assignee: FUJITSU GENERAL LIMITED, Kawasaki-shi, Kanagawa (JP)

( * ) Notice: Subject to any disclaimer, the term of this patent is extended or adjusted under 35 U.S.C. 154(b) by 4 days.

(21) Appl. No.: 15/077,383

(22) Filed: Mar. 22, 2016

(65) Prior Publication Data

US 2016/0281998 A1 Sep. 29, 2016

(30) Foreign Application Priority Data

Mar. 26, 2015 (JP) ..... 2015-064247
Mar. 26, 2015 (JP) ..... 2015-064248

(51) Int. Cl.

| | |
|---|---|
| ***F24D 5/10*** | (2006.01) |
| ***F24F 1/00*** | (2011.01) |
| ***F24F 13/14*** | (2006.01) |
| ***F24F 13/20*** | (2006.01) |
| ***F24F 13/30*** | (2006.01) |

(52) U.S. Cl.

CPC ..... *F24F 1/0022* (2013.01); *F24F 1/0014* (2013.01); *F24F 13/14* (2013.01); *F24F 13/1426* (2013.01); *F24F 13/20* (2013.01); *F24F 13/30* (2013.01); *F24F 2001/0037* (2013.01); *F24F 2013/1433* (2013.01)

(58) Field of Classification Search

CPC ..... F24F 1/0014; F24F 1/0022; F24F 2001/0037; F24F 13/14; F24F 13/1426; F24F 13/20; F24F 13/30; F24F 2013/1433

See application file for complete search history.

(56) References Cited

U.S. PATENT DOCUMENTS 6,089,972 A * 7/2000 Gunji ..... F24F 1/0011 454/233
6,450,880 B1 * 9/2002 Asahina ..... F24F 1/0011 454/233
9,328,938 B2 * 5/2016 Michitsuji ..... F24F 13/00
(Continued)

FOREIGN PATENT DOCUMENTS

JP 2003-240258 A 8/2003
JP 2009-103401 A 5/2009

*Primary Examiner* — Len Tran
*Assistant Examiner* — Gordon Jones
(74) *Attorney, Agent, or Firm* — Manabu Kanesaka

(57) ABSTRACT

A ceiling-embedded air conditioner includes: a main unit; a decorative panel having an outer frame portion, an inner frame portion disposed more inside than the outer frame portion, and connection portions connecting the outer frame portion and the inner frame portion at corner portions; a blowoff path disposed between the outer frame portion and the inner frame portion; blowoff openings formed between the adjacent connection portions in the blowoff path; and wind direction plates covering the blowoff path. The wind direction plates include shaft portions. Plate-like bearing support columns are erected from the connection portions. The bearing support columns include at the tips shaft holes for supporting pivotally the shaft portions and include ventilation holes between the shaft holes and the connection portions.

5 Claims, 12 Drawing Sheets

(56) References Cited

U.S. PATENT DOCUMENTS

| | | | | |
|---|---|---|---|---|
| 2001/0054493 | A1* | 12/2001 | Hatanaka | F24F 1/0011 165/53 |
| 2002/0108391 | A1* | 8/2002 | Kim | F24F 1/0011 62/407 |
| 2006/0213216 | A1* | 9/2006 | Sakashita | F24F 1/0011 62/419 |
| 2006/0276123 | A1* | 12/2006 | Sanagi | F24F 1/0011 454/292 |
| 2014/0352935 | A1* | 12/2014 | Gruener | F28F 9/00 165/166 |

* cited by examiner

CEILING-EMBEDDED AIR CONDITIONER

CROSS-REFERENCE TO RELATED APPLICATION

This application claims priority from Japanese Patent Application Nos. 2015-064247 and 2015-064248 filed with the Japan Patent Office on Mar. 26, 2015, the entire contents of which are hereby incorporated by reference.

BACKGROUND

1. Technical Field

The present disclosure relates to a ceiling-embedded air conditioner with a main unit embedded in a ceiling. More specifically, the present disclosure relates to a structure of bearing portions supporting pivotally wind direction plates and a structure of motor covers housing motors driving the wind direction plates.

2. Description of the Related Art

In ceiling-embedded air conditioners, a box-shaped main unit including a heat exchanger and a blowing fan (turbo fan) is embedded in a ceiling. A suction grill of a decorative panel mounted on the bottom surface of the main unit sucks air. The heat exchanger conducts heat exchange between the sucked air and a refrigerant. The heat-exchanged air is sent out from a blowoff opening to the interior of a room in a direction adjusted by a wind direction plate. Such air conditioners are used in relatively wide rooms of offices, stores, and others.

In a conventional ceiling-embedded air conditioner, support holes are provided in wall surfaces on the blowoff opening side of the decorative panel with a blowoff opening (air conditioner main body). Movable shafts of the wind direction plate are put in the support holes to support the wind direction plate. The wind direction plate turns up and down to blow air in one direction (refer to JP-A-2003-240258).

In another ceiling-embedded air conditioner, a suction grill is provided in the center of a square flat decorative panel. Blowoff openings are provided on the periphery of the suction grill along each side of the square. Further, the ceiling-embedded air conditioner includes wind direction plates for changing the directions of air blown from the blowoff openings and motors for driving the wind direction plates. The motors are housed in protective members and installed at corner portions of the back surface of the decorative panel (JP-A-2009-103401).

SUMMARY

A ceiling-embedded air conditioner includes: a box-shaped main unit that is embedded in a ceiling of an air-conditioned room, and includes a blowing fan and a heat exchanger surrounding the blowing fan inside; a square decorative panel that is mounted on the lower surface of the main unit and covers the ceiling, the decorative panel including an outer frame portion, an inner frame portion disposed more inside than the outer frame portion, and connection portions connecting the outer frame portion and the inner frame portion at corner portions; a blowoff path that is disposed between the outer frame portion and the inner frame portion; a blowoff opening that is an opening formed between the adjacent connection portions in the blowoff path; and a wind direction plate that is provided along each side of a square of the decorative panel to cover the blowoff path and is longer than a long side of the blowoff opening. The wind direction plate includes a shaft portion, a plate-like bearing support column is erected from the connection portion, and the bearing support column includes at the tip a shaft hole for supporting pivotally the shaft portion and includes a ventilation hole between the shaft hole and the connection portion.

DESCRIPTION OF THE EMBODIMENTS

Figure 1:
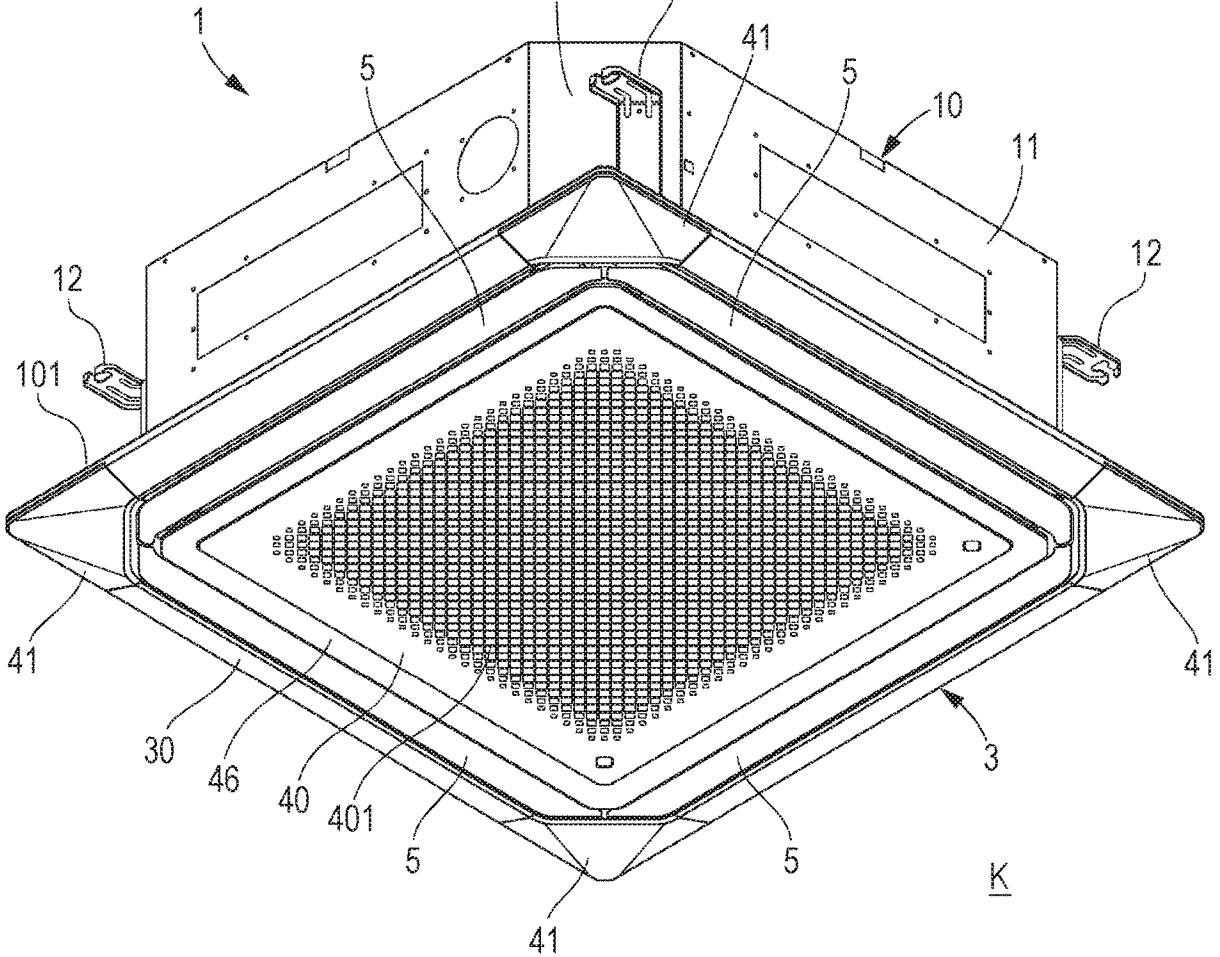
FIG. 1 is an external view of a ceiling-embedded air conditioner in a shutdown state.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

The ceiling-embedded air conditioner described in JP-A-2003-240258 blows air in one direction along the blowoff opening but does not blow air in the directions of the corner portions of the decorative panel. This causes uneven temperatures in the air-conditioned room.

Of the wall surfaces of the decorative panel with the support holes, the wall surface on the blowoff opening side through which the air flows and the wall surface on the main body side opposed to the former wall surface have a difference in temperature to generate dew condensation. It is thus necessary to provide a heat insulating member on the wall surface on the blowoff opening side.

The ceiling-embedded air conditioner described in JP-A-2009-103401 also blows air from the blowoff openings along the four sides of the decorative panel but does not blow air in the directions of the corner portions of the decorative panel. This leads to uneven temperatures in the air-conditioned room.

In addition, the motors for driving the wind direction plates are installed on the back surface of the decorative panel. Accordingly, the decorative panel needs to be removed for maintenance of the motors. The maintenance issue could be resolved by providing the motors on the front surface of the decorative panel. In this case, however, the motors are presumed to hinder the ventilation of the blown air.

An object of the present disclosure is to provide a ceiling-embedded air conditioner described below. That is, the ceiling-embedded air conditioner can blow air in all directions. The ceiling-embedded air conditioner is less prone to cause a temperature difference between the wall surface supporting pivotally the wind direction plate and the back surface.

Another object of the present disclosure is to provide a ceiling-embedded air conditioner as described below. That is, the ceiling-embedded air conditioner can blow air in all directions. The ceiling-embedded air conditioner further allows motors for driving wind direction plates to be maintained from the front surface of the decorative panel. The ceiling-embedded air conditioner makes the motors less prone to be resistance to the ventilation of blown air.

A ceiling-embedded air conditioner according to an aspect of the present disclosure, includes: a box-shaped main unit that is embedded in a ceiling of an air-conditioned room, and includes a blowing fan and a heat exchanger surrounding the blowing fan inside; a square decorative panel that is mounted on the lower surface of the main unit and covers the ceiling, the decorative panel including an outer frame portion, an inner frame portion disposed more inside than the outer frame portion, and connection portions connecting the outer frame portion and the inner frame portion at corner portions; a blowoff path that is disposed between the outer frame portion and the inner frame portion; a blowoff opening that is an opening formed between the adjacent connection portions in the blowoff path; and a wind direction plate that is provided along each side of a square of the decorative panel to cover the blowoff path and is longer than a long side of the blowoff opening. The wind direction plate includes a shaft portion, a plate-like bearing support column is erected from the connection portion, and the bearing support column includes at the tip a shaft hole for supporting pivotally the shaft portion and includes a ventilation hole between the shaft hole and the connection portion.

In the thus configured ceiling-embedded air conditioner, the decorative panel has the wind direction plates longer than the long sides of the blowoff openings and the blowoff paths. Accordingly, the ceiling-embedded air conditioner can send air in all directions. The plate-like bearing support columns are erected at the connection portions of the decorative panel. The bearing support columns include the shaft holes for pivotally supporting the shaft portions of the wind direction plates. The bearing support columns include the ventilation holes between the shaft holes and the connection portions. This makes the bearing support columns less prone to be resistance to the ventilation. As a result, a larger volume of air can be blown. Further, it is possible to suppress generation of dew condensation on the both surfaces of the bearing support columns. This eliminates the need for providing heat insulating members on the bearing support columns.

A ceiling-embedded air conditioner according to another aspect of the present disclosure includes: a box-shaped main unit that is embedded in a ceiling of an air-conditioned room, and includes a blowing fan and a heat exchanger surrounding the blowing fan inside; a square decorative panel that is mounted on the lower surface of the main unit and covers the ceiling, the decorative panel including an outer frame portion, an inner frame portion disposed more inside than the outer frame portion, and connection portions connecting the outer frame portion and the inner frame portion at corner portions; a blowoff path that is disposed between the outer frame portion and the inner frame portion; a blowoff opening that is an opening formed between the adjacent connection portions in the blowoff path; a wind direction plate that is provided along each side of a square of the decorative panel to cover the blowoff path and is longer than a long side of the blowoff opening; a motor; a motor cover including a motor housing portion; and a shaft portion that is included in the wind direction plate and is pivotally supported and turned by a bearing portion of the motor. The motor is housed in the motor housing portion of the motor cover and is fixed to the connection portion together with the motor cover, the motor housing portion includes a bearing surface surrounding the bearing portion on the blowoff opening side, and the bearing surface inclines from a peak of the motor housing portion toward the blowoff opening.

In the thus configured ceiling-embedded air conditioner, the decorative panel is provided with the wind direction plates longer than the long side of the blowoff openings and the blowoff paths. Accordingly, the ceiling-embedded air conditioner can send air in all directions. In addition, the motors for rotating the wind direction plates are fixed in the blowoff paths together with the motor covers. This allows the motors to be maintained from the front surface of the decorative panel. Further, the bearing surfaces of the motor covers surrounding the bearing portions of the motors are inclined toward the blowoff openings. This makes the motors less prone to be resistance to the ventilation of blown air.

An embodiment of the present disclosure will be described below with reference to the accompanying drawings. However, the technique of the present disclosure is not limited to this.

Figure 2:
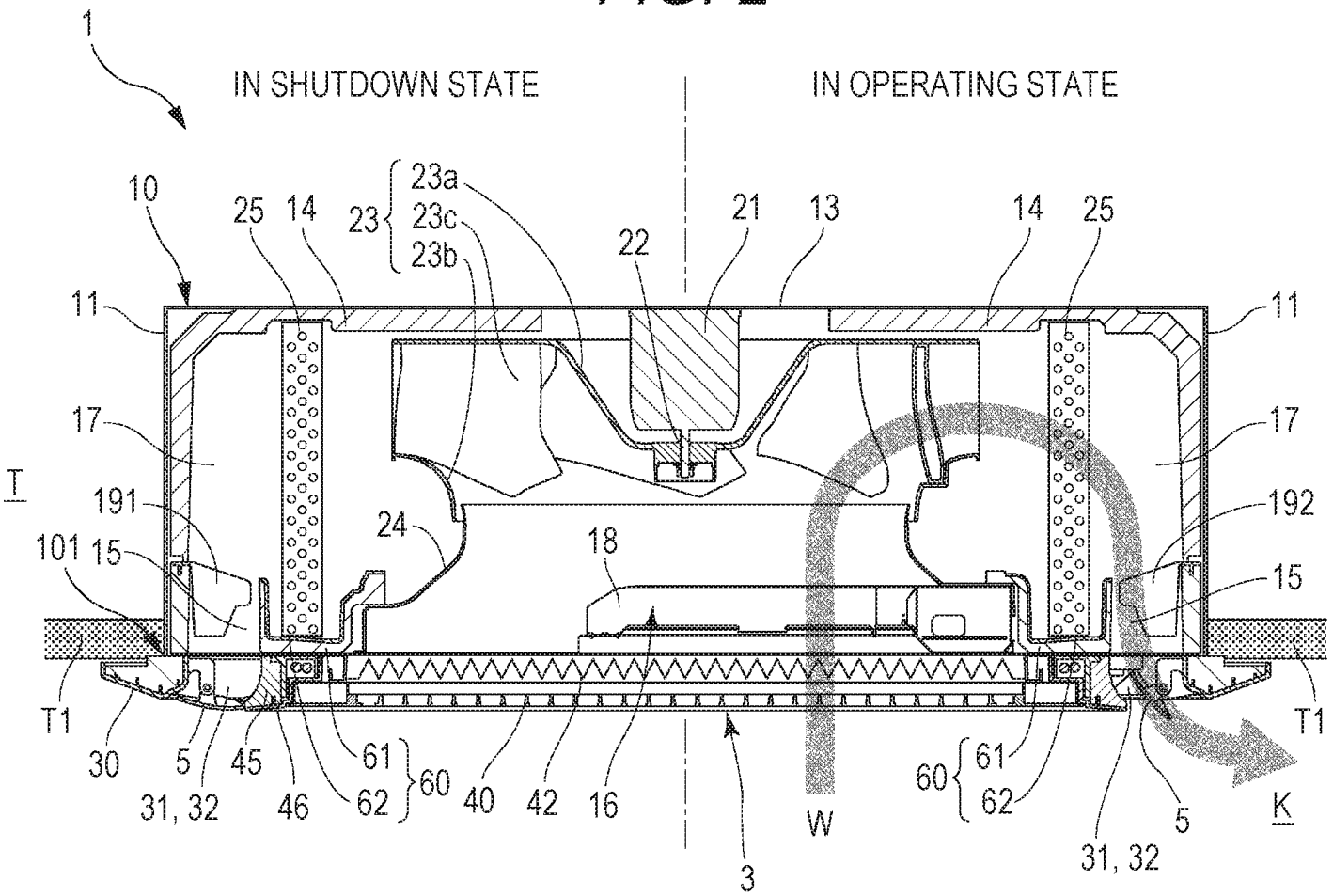
FIG. 2 is a cross-sectional view of the ceiling-embedded air conditioner in which the right side indicates an operational state and the left side indicates a shutdown state.
Figure 3:
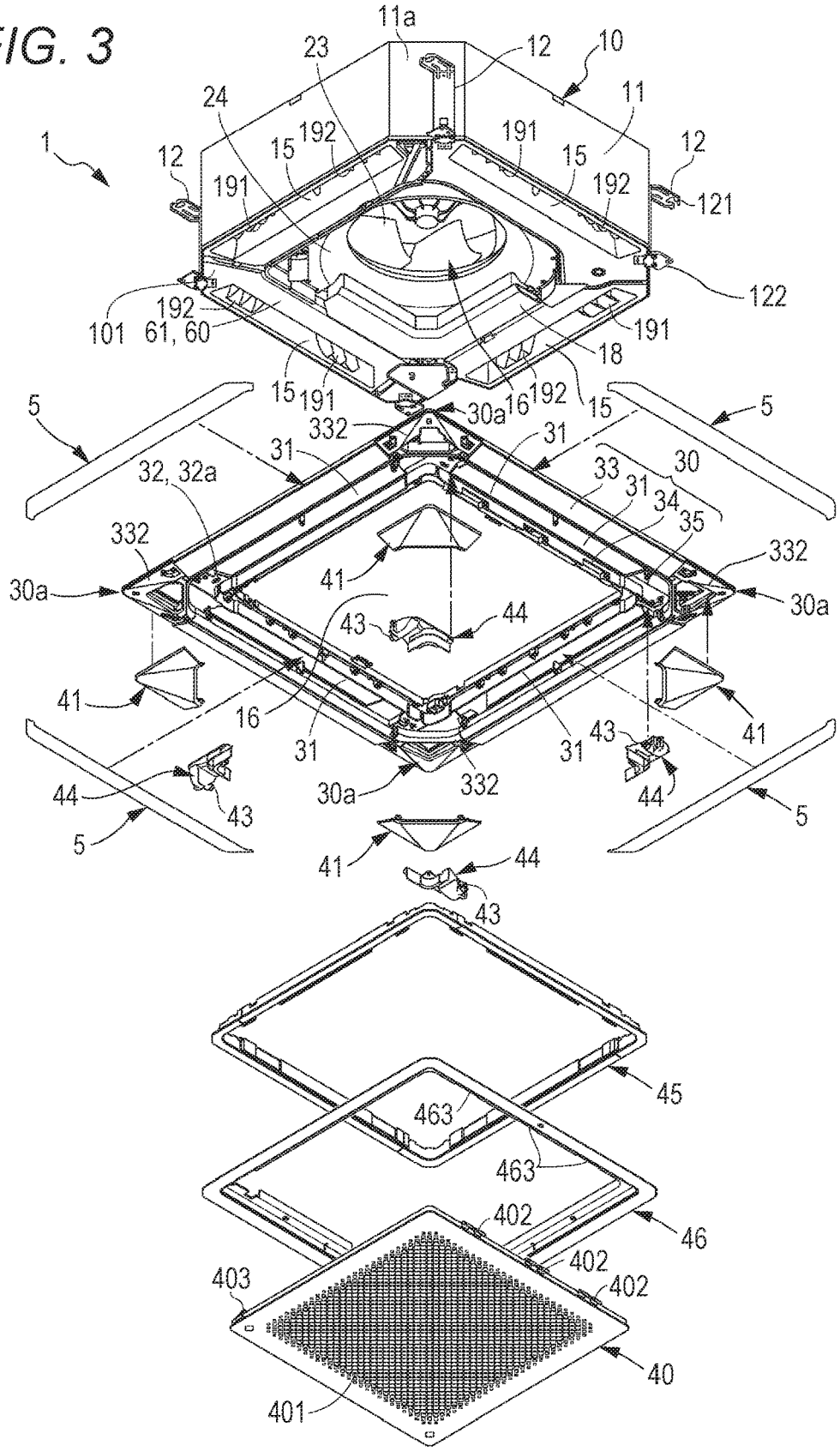
FIG. 3 is an exploded view of the ceiling-embedded air conditioner.

As illustrated in FIGS. 1 to 3, a ceiling-embedded air conditioner 1 according to the embodiment (hereinafter, referred to as air conditioner 1) includes a box-shaped main unit 10 embedded in a ceiling T within an air-conditioned room K and a square decorative panel 3 that is mounted on a bottom surface 101 of the main unit 10 to cover the ceiling T.

The outer frame of the main unit 10 is composed of a top plate 13 and side plates 11. The top plate 13 is formed from a metal plate. The shape of the top plate 13 is an approximately octagon in which the four sides of a square are set as long sides and the four sides formed by chamfering the four corners of the square are set as short sides. The side plates 11 extend downward from the outer periphery of the top plate 13. Attachment metal brackets 12 are fixed to the side plates 11. The attachment metal bracket 12 is provided at each of the four side plates 11*a* positioned along the short sides of the top plate 13. Hanging portions 121 include hanging portions 121 and fixing portions 122 bent outward. The main unit 10 is installed on the ceiling T by hanging the hanging portions 121 with a plurality of hanging bolts not illustrated embedded in the wall surface of the back of the ceiling.

In the following description, the top plate 13 side of the main unit 10 in FIG. 2 is defined as upper surface or upper side, and the air-conditioned room K side of the main unit 10 is defined as lower surface or lower side. The same thing applies to other components.

Heat insulating members 14 are provided on the inner peripheral surfaces of the top plate 13 and the side plates 11 of the main unit 10 as illustrated in FIG. 2. A fan motor 21 is screwed into the inside of the top plate 13 in the center. A hub 23*a* of a blowing fan 23 is pivotally supported by a shaft 22 extending downward from the fan motor 21. The blowing fan 23 is a turbo fan including the hub 23*a*, a shroud 23*b*, and a plurality of blades 23*c*.

A drain pan 60 covers the lower part of the main unit 10. The central part of the drain pan 60 is opened as a suction opening 16. A bell mouth 24 is disposed in the suction opening 16 to connect the suction opening 16 and the blowing fan 23. An electric equipment box 18 is disposed in the bell mouth 24 on the suction opening 16 side. The electric equipment box 18 is formed in an L shape so as not to hinder air W passing through the suction opening 16. Electric components for controlling the ceiling-embedded air conditioner 1 are housed in the electric equipment box 18.

The blowing fan 23 driven rotationally by the fan motor 21 sucks the air W in the air-conditioned room from the suction opening 16 into the main unit 10. The air W sucked into the main unit 10 is guided to the blowing fan 23 along the bell mouth 24 and is blown toward the outside of the blowing fan 23.

A heat exchanger 25 is disposed around the blowing fan 23 to surround the blowing fan 23. The heat exchanger 25 is vertically sandwiched between the heat insulating members 14 and the drain pan 60. The drain pan 60 receiving the lower part of the heat exchanger 25 includes a heat insulating member 61 and a drain sheet 62. The rein drain sheet 62 is provided on the surface opposed to the heat exchanger 25. The drain sheet 62 is molded integrally with the foamed-resin heat insulating member 61 to receive drain water generated by the heat exchanger 25. The drain water is discharged to the outside of the room through a drain pump and a drain pipe connected to the drain pump not illustrated.

The heat exchanger 25 is connected to a reversible refrigeration cycle circuit (not illustrated) capable of cooling operation and heating operation. During the cooling operation, the heat exchanger 25 serves as an evaporator to cool the air W guided by the blowing fan 23. Meanwhile, during the heating operation, the heat exchanger 25 serves as a condenser to heat the air W guided by the blowing fan 23.

A blowing path 17 is formed by the space between the heat exchanger 25 and the heat insulating members 14 on the inner peripheral surfaces of the side plates 11 and four main body blowoff openings 15 provided in the drain pan 60 respectively along the four sides of the main unit 10. The blowing path 17 guides the air W blown from the blowing fan 23 to blowoff openings 31 of the decorative panel 3 described later. The air W after heat exchange with a refrigerant by the heat exchanger 25 passes through the blowing path 17 and the main body blowoff openings 15, and is blown from the later described blowoff openings 31 into the air-conditioned room K.

The air conditioner 1 can blow air in all directions by a blowoff path 32 and wind direction plates 5 (later described) without auxiliary blowoff openings at four corners between the main unit 10 and the decorative panel 3.

Figure 13:
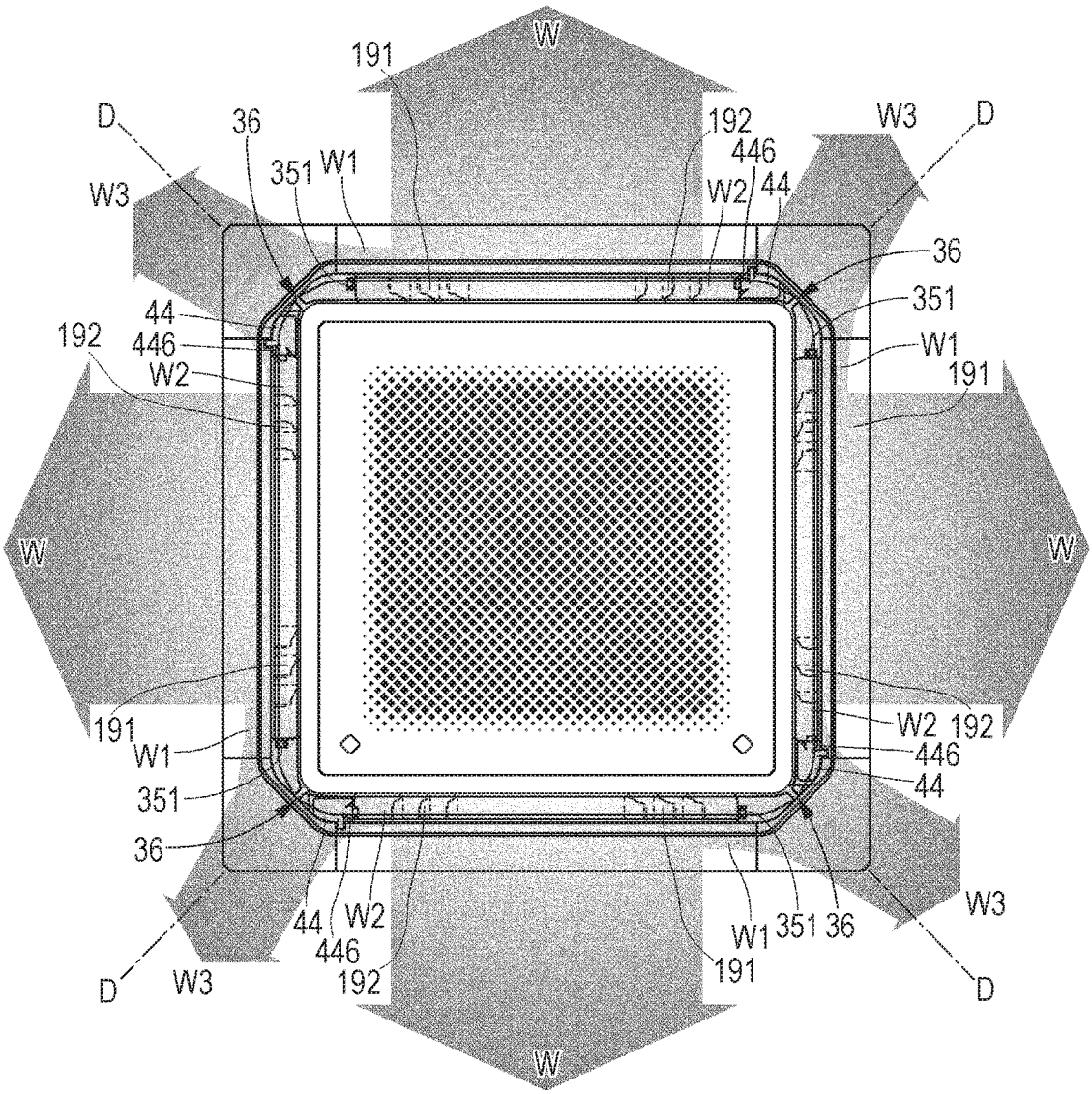
FIG. 13 is an illustrative view showing the directions in which blown air flows.

Rectifier plates 191 and 192 are provided in the main body blowoff openings 15 to further guide the air W to the four corners. As illustrated in FIGS. 2, 3 and 13, the rectifier plates 191 and 192 include curved surfaces toward the outside of the main body blowoff openings 15 in the longitudinal direction. The rectifier plates 191 and 192 are opposed to each other at two places in the main body blowoff openings 15.

The rectifier plates 191 send air in directions toward bearing support columns 351 erected from a decorative panel main body 30 described later (in the directions of the bearing support columns 351). The rectifier plates 192 send air in directions toward motor covers 44 described later fixed to the decorative panel main body 30 (in the directions of the motor covers 44). There is no airflow resistance in the directions of the bearing support columns 351. Accordingly, the rectifier plates 191 are formed in a sharp arc shape to guide a large volume of air in the directions of the bearing support columns 351. Meanwhile, the motor covers 44 constitute airflow resistance in the directions of the motor covers 44, and the air is less prone to flow than in the directions of the bearing support columns 351. Accordingly, the rectifier plates 192 are formed in a gentler arc shape than the rectifier plates 191 to guide and pass the air under the motor covers 44.

Figure 4:
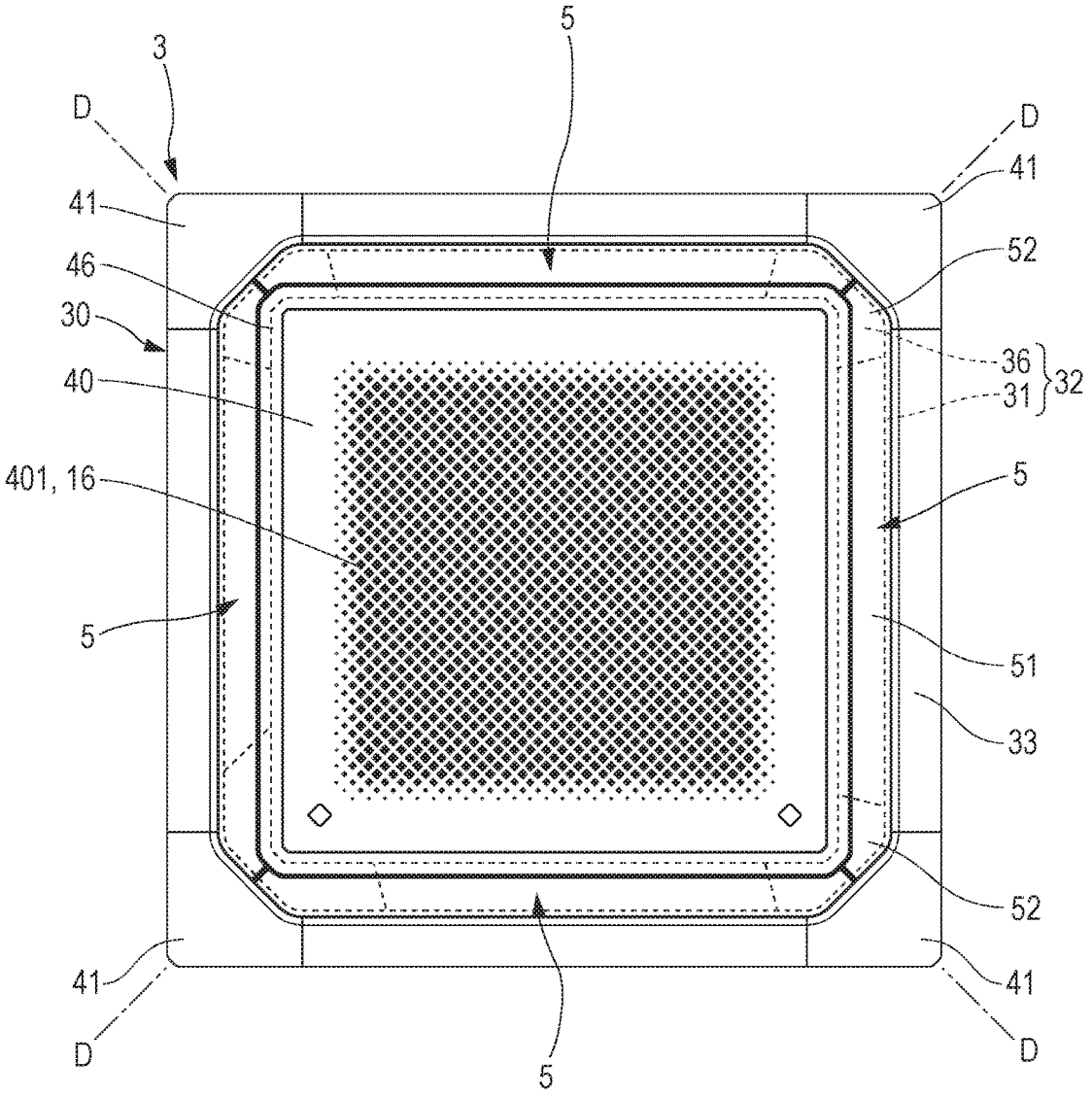
FIG. 4 is a front view of the ceiling-embedded air conditioner in the shutdown state.

As described above, the decorative panel 3 is mounted on the bottom surface 101 of the main unit 10. The decorative panel 3 is a square frame plate as illustrated in FIG. 4, for example. The decorative panel 3 covers the bottom surface 101 of the main unit 10. When the air conditioner 1 is installed in the ceiling surface T1, the decorative panel 3 covers the ceiling surface T1 around the bottom surface 101 of the main unit 10.

As illustrated in FIGS. 3 and 4, the decorative panel 3 has a decorative panel main body 30 with the blowoff openings 31, a suction grill 40, corner panels 41, four wind direction plates 5, motors 43, four motor covers 44, a panel heat insulating member 45, and a suction grill frame 46. The suction grill 40 is detachably attached to the center of the decorative panel main body 30. The corner panels 41 cover corner portions 30*a* of the decorative panel main body 30. The four wind direction plates 5 are pivotally supported by the decorative panel main body 30. The four motors 43 respectively drive the four wind direction plates 5. The four motor covers 44 also serve as motor fixtures for fixing the motors 43 to the decorative panel main body 30. The panel heat insulating member 45 forms the inner peripheral sides of the blowoff openings 31. The suction grill frame 46 receives the suction grill 40 and serves also as a fixture for fixing the panel heat insulating member 45 to the decorative panel main body 30.

Figure 5:
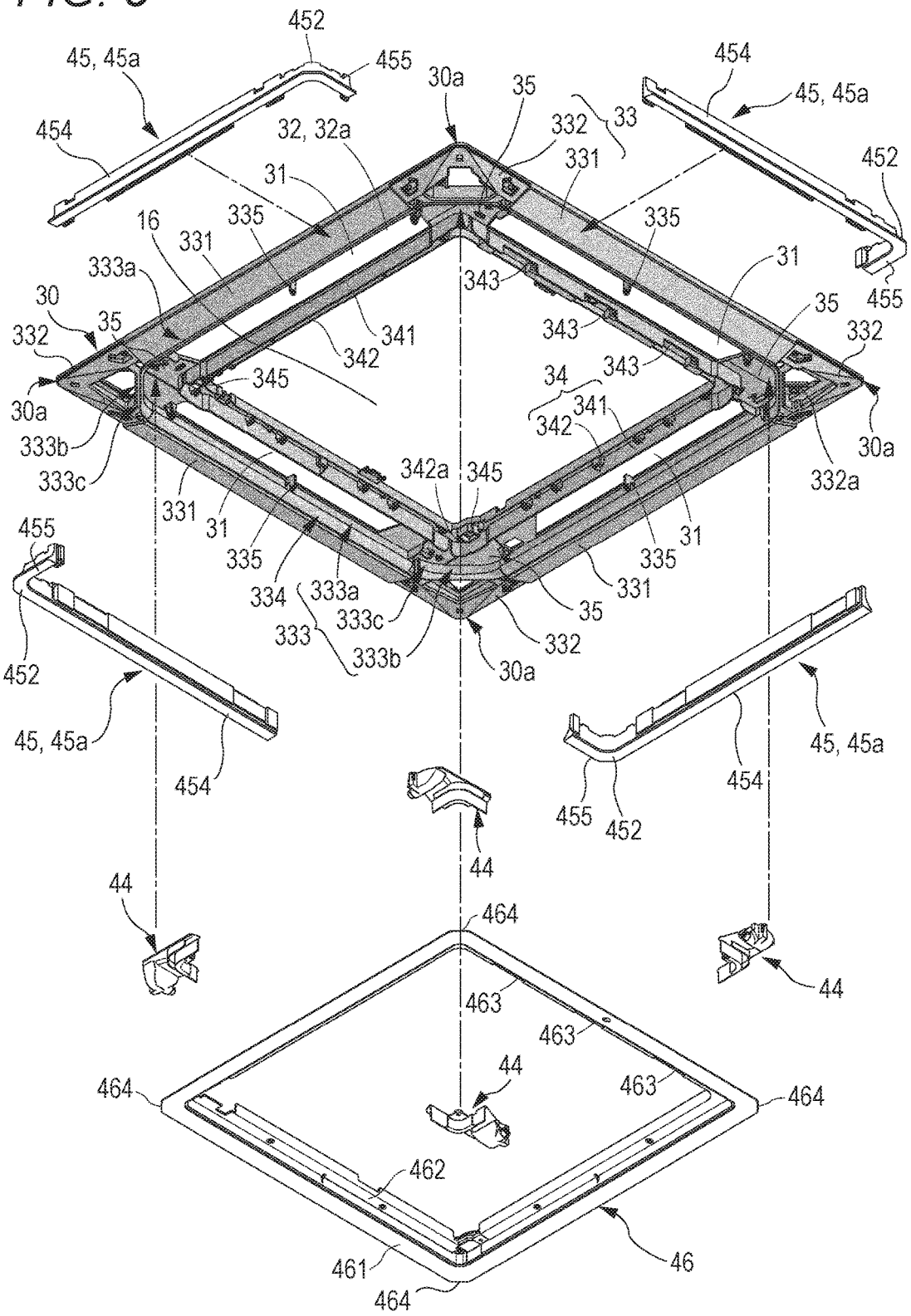
FIG. 5 is an exploded view of a decorative panel of the ceiling-embedded air conditioner.

As illustrated in FIG. 5, the decorative panel main body 30 includes a square outer frame portion 33, an inner frame portion 34, and connection portions 35. The inner frame portion 34 is positioned more inside than the outer frame portion 33 to house the suction grill 40. The connection portions 35 connect the outer frame portion 33 and the inner frame portion 34 at the corner portions 30*a* of the decorative panel main body 30 on the main unit 10 side. Grooves 32*a* between the outer frame portion 33 and the inner frame portion 34 constitute the blowoff path 32. Openings formed between the adjacent connection portions 35 in the blowoff path 32 constitute the blowoff openings 31 corresponding to the main body blowoff openings 15.

In addition, spaces formed at the corner portions of the blowoff path 32 under the connection portions 35 constitute corner blowoff portions 36 described later.

Figure 6:
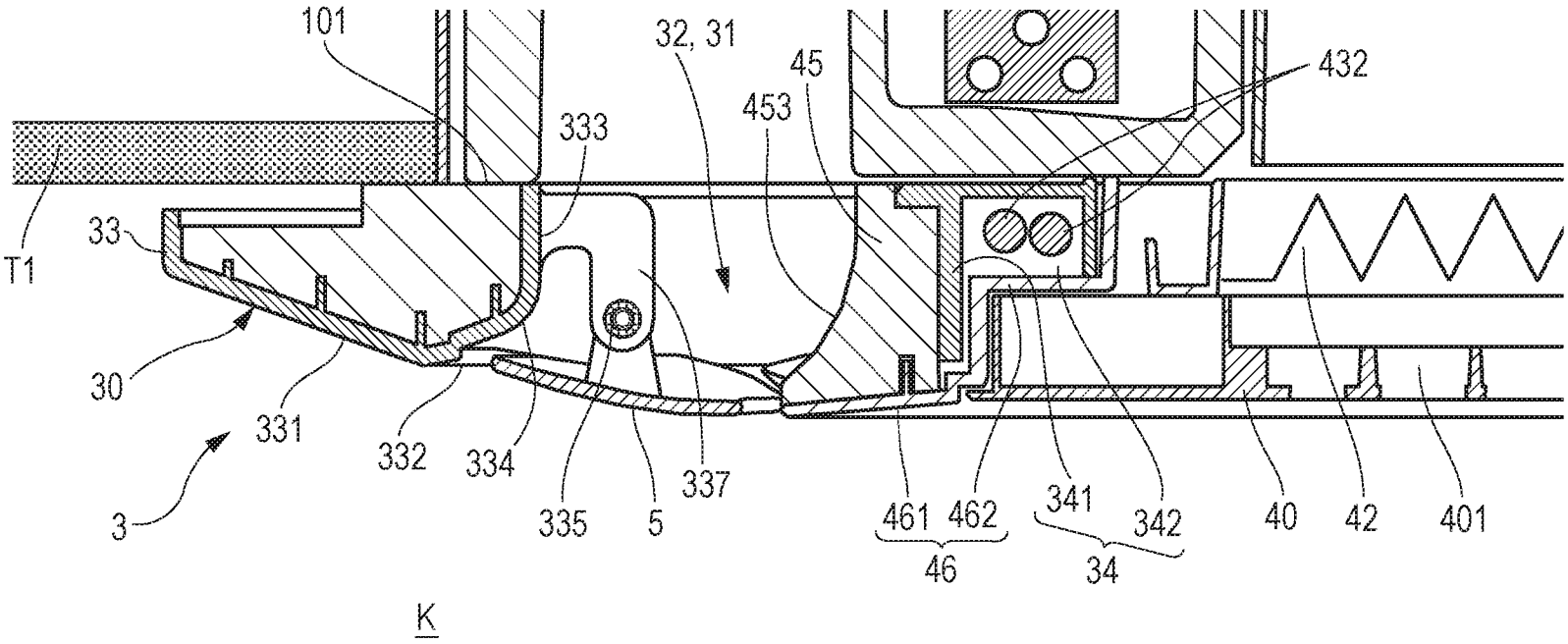
FIG. 6 is an enlarged view of FIG. 2 in the shutdown state.
Figure 7:
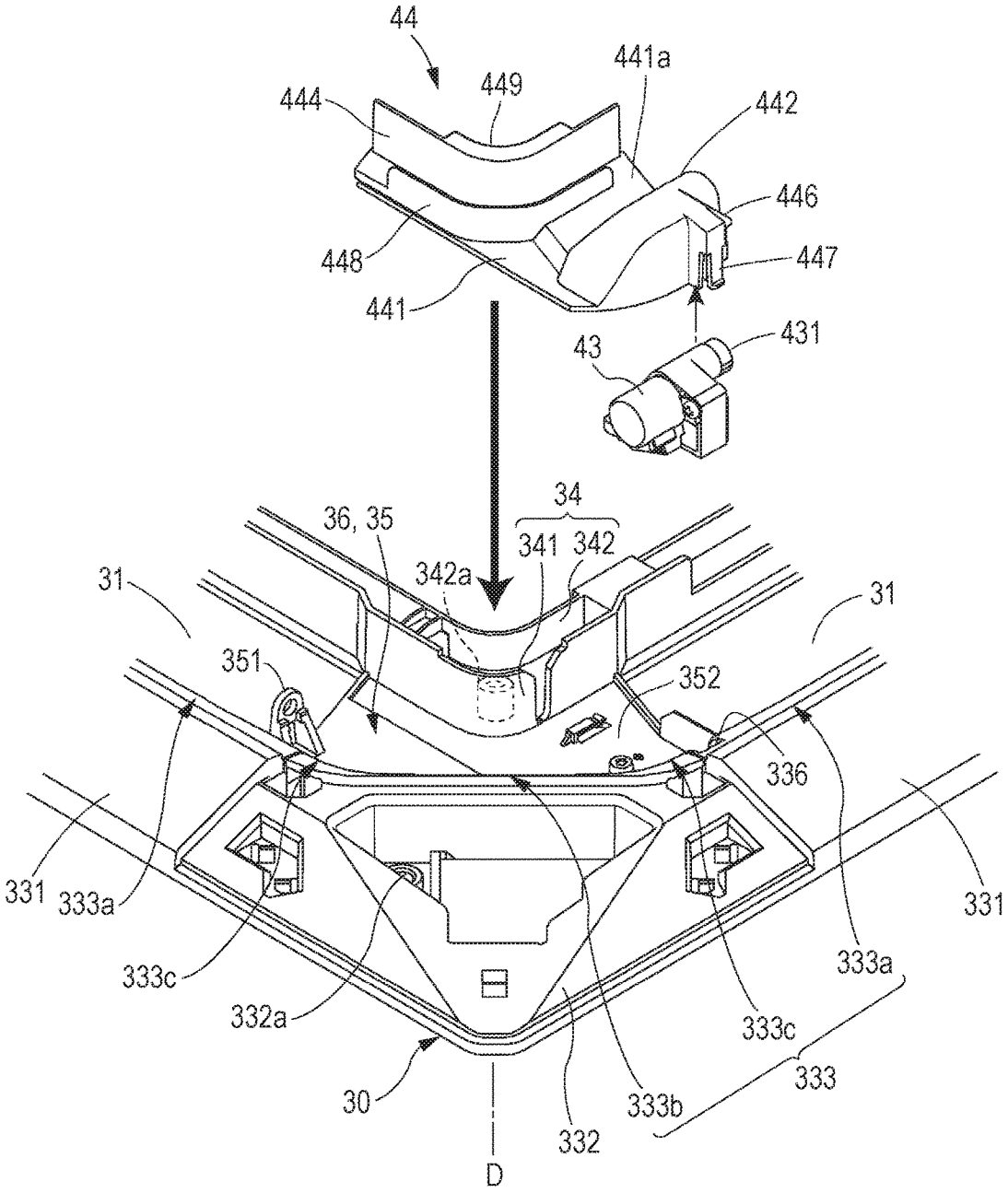
FIG. 7 is an illustrative view of the decorative panel, a motor, and a motor cover of the ceiling-embedded air conditioner.

The outer frame portion 33 has decorative surfaces 331 facing the air-conditioned room K corresponding to the four sides of the square decorative panel main body 30 as illustrated in FIGS. 5 to 7. The decorative surfaces 331 are inclined such that the blowoff opening 31 side protrudes toward the air-conditioned room K and the ceiling surface T1 side is close to the ceiling surface T1. Attachment portions 332 are provided at the four corner portions 30*a* connecting the decorative surfaces 331. The decorative panel 3 can be fixed to the main unit 10 by screwing the fixing portions 122 of the attachment brackets 12 into screw holes 332*a* of the attachment parts 332.

As illustrated in FIG. 7, portions of an edge surface 333 of the outer frame portion 33 facing the blowoff path 32 and contacting the blowoff openings 31 include linearly-formed first straight portions 333*a*. Portions of the edge surface 333 connected to the connection portions 35 include second straight portions 333*b* and are portions 333*c*. The second straight portions 333*b* incline 45 degrees relative to the first straight portions 333*a*. The arc portions 333*c* connect the first straight portions 333*a* and the second straight portions 333*b* in a gentle arc shape.

As illustrated in FIG. 6, the decorative surfaces 331 and the attachment portions 332 facing the air-conditioned room K are connected to the edge surface 333 facing the blowoff path 32 by the arc-shaped curved surface 334. Bearing arms 337 are provided in the middle of the edge surface 333. The bearing arms 337 protrude toward the blowoff openings 31 and extend downward. Bearing portions 335 are provided at the lower ends of the bearing arms 337 to support pivotally the wind direction plates 5 at the center thereof.

The inner frame portion 34 of the decorative panel main body 30 includes an inner wall portion 341 and a cable path 342 as illustrated in FIGS. 5 and 6. The inner wall portion 341 is erected on the blowoff path 32 side. The cable path 342 is provided on the entire inner periphery of the inner wall portion 341. The cable path 342 guides a cable 432 drawn from the motor 43 described later to the electric equipment box 18.

As illustrated in FIG. 6, a panel heat insulating member 45 is provided in the blowoff path 32 on the suction grill 40 side. The panel heat insulating member 45 has a curved surface 453 on the blowoff path 32 side. Accordingly, the panel heat insulating member 45 (curved surface 453) serves as a blowoff guide that guides the air W blown from the blowoff openings 31 toward the air-conditioned room K. The panel heat insulating member 45 is formed by combining four L-shaped panel heat insulating member pieces 45*a* as illustrated in FIG. 5. Each of the panel heat insulating member pieces 45*a* has a long side portion 454 and a short side portion 455 orthogonal to each other at a corner portion 452.

The corner portions 452 of the panel heat insulating member 45 also have the curved surface 453 on the blowoff path 32 side. Accordingly, the panel heat insulating member 45 (curved surface 453) also serves as a blowoff guide that guides auxiliary blown airs W1, W2, and W3 described later to the corner blowoff portions 36. The panel heat insulating member 45 is fixed between the suction grill frame 46 and the inner wall portion 341 of the inner frame portion 34 of the decorative panel main body 30.

The suction grill frame 46 includes a decorative surface 461 and a receiving portion 462. The decorative surface 461 surrounds the suction grill 40 in a frame form and is flush with the suction grill 40. The receiving portion 462 is provided inside the decorative surface 461 in a step-like manner to receive the suction grill 40. The receiving portion 462 is screwed into the cable path 342 of the inner frame portion 34 of the decorative panel main body 30. Accordingly, the receiving portion 462 serves as a cover for the cable path 342 to suppress the drop of the cable 432. The suction grill frame 46 has a square shape. The suction grill frame 46 has tapered surfaces 464 at the corners on the blowoff path 32 side along the wind direction plates 5 described later.

As illustrated in FIGS. 1 to 4, the square suction grill 40 is detachably attached in the suction grill frame 46. The suction grill 40 includes a plurality of dot-like suction holes 401 to take the air into the suction opening 16. A dedusting filter 42 is detachably held on the rear surface (the upper surface in FIG. 2) of the suction grill 40.

As illustrated in FIG. 3, rotation shafts 402 are provided at three places on one side of peripheral edge of the suction grill 40. Fasteners 403 are provided on the rear surface of the suction grill 40. As illustrated in FIG. 5, bearing portions 343 are provided on the inner wall portion 341 of the inner frame portion 34 of the decorative panel main body 30. Bearing portions 463 are provided at the receiving portion 462 of the suction grill frame 46. The bearing portions 343 and the bearing portions 463 sandwich and support pivotally the rotation shafts 402 of the suction grill 40. The fasteners 403 are locked in fastener holes 345. The fastener holes 345 are provided in the cable path 342 of the inner frame portion 34 of the decorative panel main body 30. Accordingly, the suction grill 40 can turn via the rotation shafts 402 relative to the bearing portions 343 and the bearing portions 463. Therefore, the suction grill 40 can be turned and removed from the decorative panel main body 30, and the suction grill 40 can be turned reversely and attached to the decorative panel main body 30. Further, the suction grill 40 can be fixed to the decorative panel main body 30 by locking the fasteners 403 in the fastener holes 345.

The components constituting the decorative panel 3 are combined to form the blowoff path 32. The blowoff path 32 includes on the outer peripheral side an edge surface 333 and a curved surface 334 of the outer frame portion 33 of the decorative panel main body 30. The blowoff path 32 includes on the inner peripheral side the panel heat insulating member 45. The blowoff path 32 includes on the bottom surface side of the grooves 32*a* includes the blowoff openings 31, the connection portions 35, and the motor covers 44 described later.

As illustrated in FIG. 4, the wind direction plates 5 are provided corresponding to the blowoff path 32 including the blowoff openings 31 provided on the entire periphery of the suction grill 40 (along each side of the square of the decorative panel 3) to cover the entire blowoff path 32 and surround the suction grill 40. The four wind direction plates 5 have the same shape. The adjacent wind direction plates 5 have gaps therebetween to avoid contact in positions corresponding to diagonals D of the square decorative panel 3. The wind direction plates 5 are longer than the long sides of the blowoff openings 31.

Figure 8A:
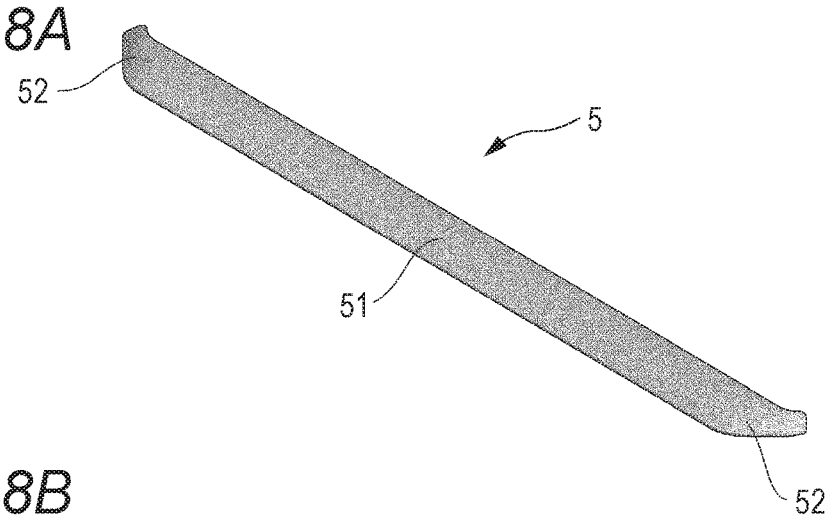
FIG. 8A is a perspective view of a wind direction plate of the ceiling-embedded air conditioner.
Figure 8B:
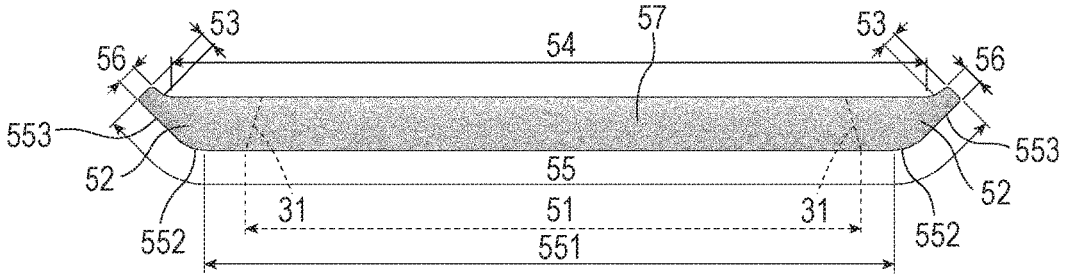
FIG. 8B is a plane view of the wind direction plate.

Each of the wind direction plates 5 has a wind direction portion 51, auxiliary wind direction portions 52, a first side portion 54, a second side portion 55, third side portions 53, and fourth side portions 56 as illustrated in FIGS. 4, 8A, and 8B. The wind direction portion 51 is a portion opposed to the blowoff opening 31. The auxiliary wind direction portions 52 are portions positioned at ends of the wind direction portion 51 and opposed to the corner blowoff portions 36 of the blowoff path 32. The first side portion 54 is a peripheral edge of the wind direction plate 5 on the suction grill 40 side. The second side portion 55 is a peripheral edge of the wind direction plate 5 on the outer frame portion 33 side (outside) opposed to the first side portion 54. The second side portion 55 includes a straight portion 551 corresponding to the blowoff opening 31 and inclined portions 553. The inclined portions 553 incline from the both ends of the straight portion 551 toward the ends of the first side portion 54.

The third side portions 53 are positioned at the ends of the first side portion 54 of the wind direction plate 5 and are in parallel to the inclined portions 553 of the second side portion 55. The fourth side portions 56 are raised from ends of the inclined portions 553 on the sides of the adjacent wind direction plates 5 vertically to the inclined portions 553 and are connected to the third side portions 53.

In the following description, as illustrated in FIG. 8B, a surface of the wind direction plate 5 appearing on the decorative panel 3 side in the shutdown state will be defined as front surface 57. In addition, as illustrated in FIG. 8F, the back of the front surface 57 of the wind direction plate 5 will be defined as back surface 58.

As illustrated in FIGS. 4 and 8B, in the wind direction portion 51, the first side portion 54 and the second side portion 55 form parallel lines corresponding to the blowoff opening 31. As illustrated in FIG. 8F, the wind direction portion 51 includes a gently curved surface swelling outward on the front surface 57.

The first side portion 54 and the third side portions 53 of the wind direction plate 5 are shaped corresponding to the suction grill frame 46 illustrated in FIG. 4. The straight portion 551 of the second side portion 55 is shaped corresponding to the first straight portion 333*a* of the edge surface 333 of the outer frame portion 33 of the decorative panel main body 30 illustrated in FIG. 7. The inclined portions 553 of the second side portion 55 is shaped corresponding to the second straight portion 333*b* of the edge surface 333 of the outer frame portion 33. The second side portion 55 has second arc portions 552. The second arc portions 552 are positioned between the straight portion 551 and the inclined portions 553, and are shaped corresponding to the arc portions 333*c* of the edge surface 333 of the outer frame portion 33.

The connection portions between the first side portion 54 or the third side portions 53 at the ends of the fourth side portions 56 and the second side portion 55 have rounded corners to avoid contact with the connections portions between the adjacent wind direction plates 5.

In the front view of FIG. 8B, the tips of the auxiliary wind direction portions 52 appear narrower than the wind direction portion 51. However, as illustrated in the side view of FIG. 8E, the first side portion 54 and the second side portion 55 are parallel to each other. The auxiliary wind direction portions 52 have an angle closer to the right angle than the wind direction portion 51.

Figure 8C:
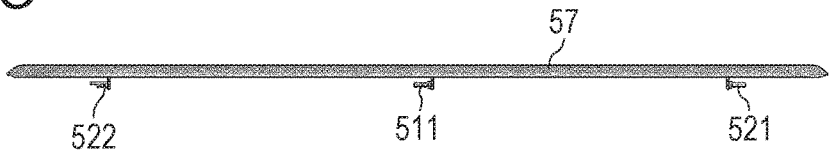
FIG. 8C is a front view of the wind direction plate.
Figure 8D:
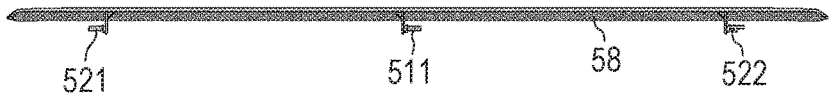
FIG. 8D is a rear view of the wind direction plate.
Figure 8E:
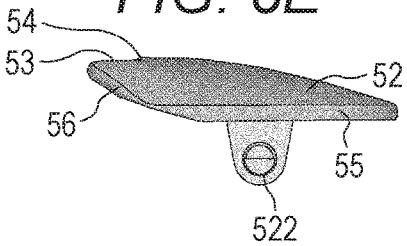
FIG. 8E is an enlarged side view of the wind direction plate.
Figure 8F:
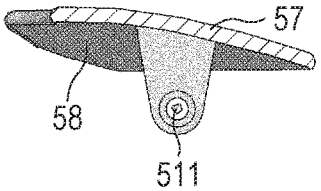
FIG. 8F is an enlarged cross-sectional view of the wind direction plate.

As illustrated in FIGS. 8C and 8D, each of the wind direction plates 5 is pivotally supported on the decorative panel main body 30 by a shaft portion 511 provided on the back surface 58 of the wind direction portion 51 and shaft portions 521 and 522 provided on the back surface 58 of the auxiliary wind direction portions 52. The shaft portion 511 is pivotally supported at the bearing portion 335 of the bearing arm 337 protruding from the outer frame portion 33 of the decorative panel main body 30 toward the blowoff opening 31. The shaft portion 521 is pivotally supported at the bearing support column 351 erected from the connection portion 35 of the decorative panel main body 30. The shaft portion 522 is pivotally supported at the motor 43 housed in the motor cover. The wind direction plates 5 are each pivotally supported at the three places and turned in a stable manner.

As illustrated in FIGS. 5 and 7, the four motors 43 are arranged at the corner blowoff portions 36 under (above in FIG. 7) the connection portions 35 of the decorative panel main body 30 to turn the four wind direction plates 5 respectively. The motors 43 are housed in the motor covers 44. The motor covers 44 also serve as motor fixtures for fixing the motors 43 to the decorative panel main body 30. The motors 43 are fixed to the connection portions 35 together with the motor covers 44.

The bearing support column 351 is provided at the connection portion 35 on the one blowoff opening 31 side. The connection portion 35 has a concave portion on the other blowoff opening 31 side. The concave portion occupies the half plane of the connection portion 35. The concave portion constitutes a motor cover attachment portion 352 for attaching the motor cover 44.

Figure 9:
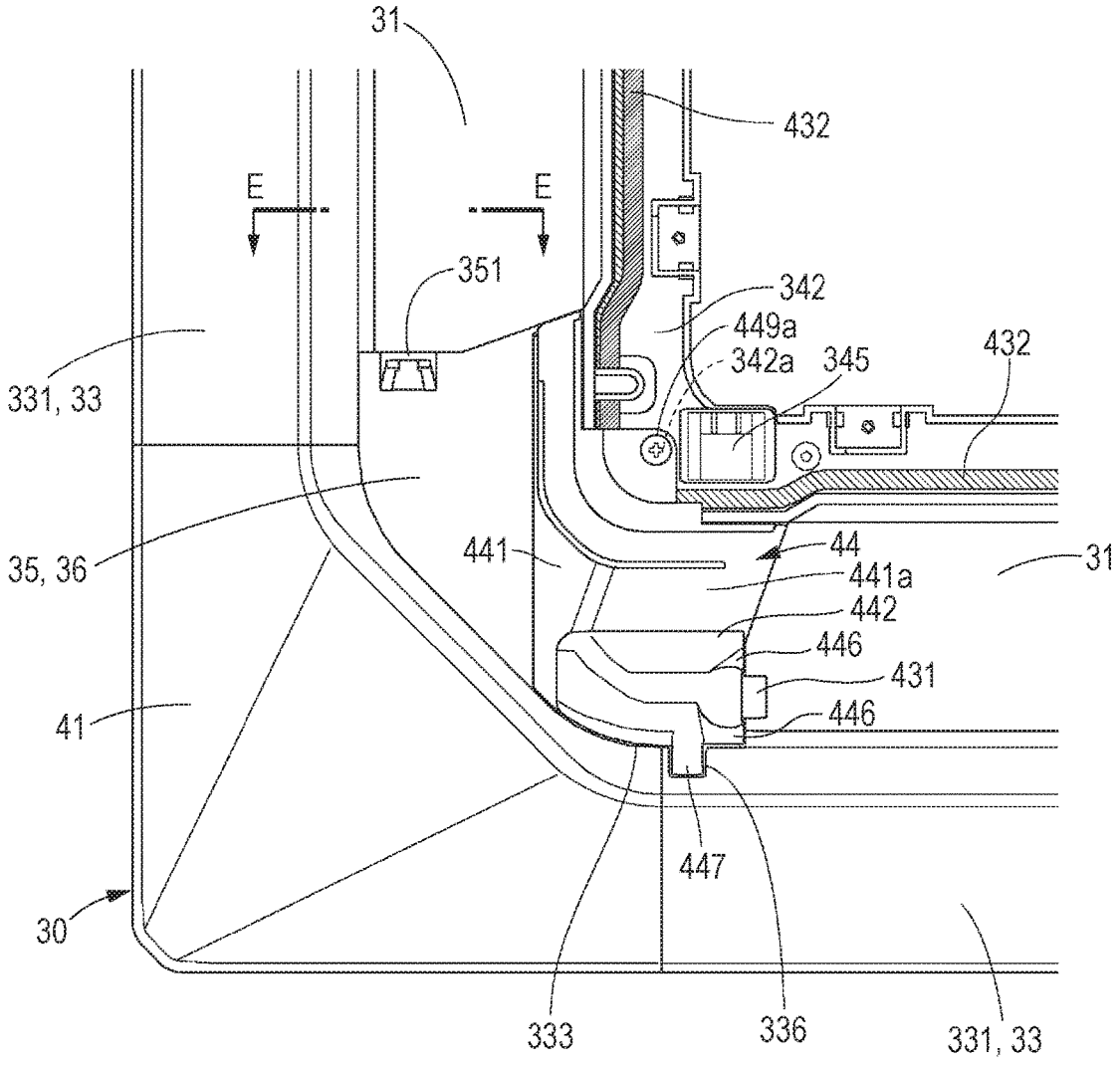
FIG. 9 is an enlarged front view of a corner portion of the decorative panel.
Figure 10:
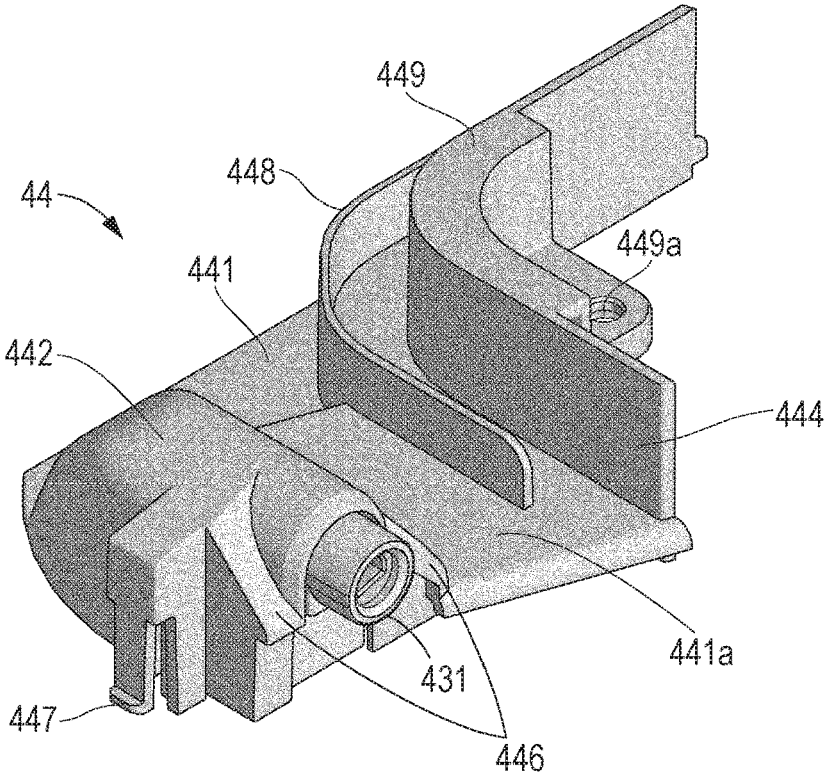
FIG. 10 is a perspective view of the motor cover.

The motor cover 44 attached to the motor cover attachment portion 352 includes a bottom path 441, a motor housing portion 442, a lock portion 447, a wall surface 444, a rib 448, and a flange 449 as illustrated in FIGS. 7, 9, and 10. The bottom path 441 is in abutment with the motor cover attachment portion 352. The motor housing portion 442 is in abutment with the edge surface 333 of the outer frame portion 33 to house the motor 43. The lock portion 447 protrudes from the motor housing portion 442 toward the edge surface 333 side. The wall surface 444 is in abutment with the inner wall portion 341 of the inner frame portion 34. The rib 448 is disposed nearer the motor housing portion 442 than the wall surface 444. Part of the panel heat insulating member 45 is housed between the rib 448 and the wall surface 444. The flange 449 overlaps the cable path 342 of the inner frame portion 34 from the wall surface 444. The flange 449 includes a screw hole 449*a*.

In the bottom path 441, the motor housing portion 442 has a base end portion 441*a* higher by one step. The cable 432 of the motor 43 housed in the motor housing portion 442 is passed through the base end portion 441*a* and is drawn from the place near the screw hole 449*a* to the cable path 342.

After the cable 432 is passed through the motor cover 44, the lock portion 447 of the motor cover 44 is locked in the lock hole 336 of the outer frame portion 33 of the decorative panel main body 30. A boss 342*a* in the cable path 342 of the inner frame portion 34 is fastened in the screw hole 449*a* of the flange 449. Accordingly, the motor cover 44 is fixed to the decorative panel main body 30.

In such a manner as described above, the motors 43 are installed in the blowoff path 32. In addition, the motors 43 can be attached or detached through the surface of the decorative panel 3. This eliminates the need to remove the decorative panel 3 from the main unit 10 for maintenance of the motors 43, for example, thereby achieving improvement in workability.

The motor housing portion 442 has a mountain shape to protrude toward the air-conditioned room K on the base end portion 441*a* side and the side nearer the blowoff opening 31 than the diagonal D of the decorative panel 3.

The motor housing portion 442 includes bearing surfaces 446 surrounding the bearing portion 431 of the motor 43 on the blowoff opening 31 side. The bearing surfaces 446 are surfaces inclined downward from the peak of the mountain-shaped motor housing portion 442 toward the blowoff opening 31.

Figure 12:
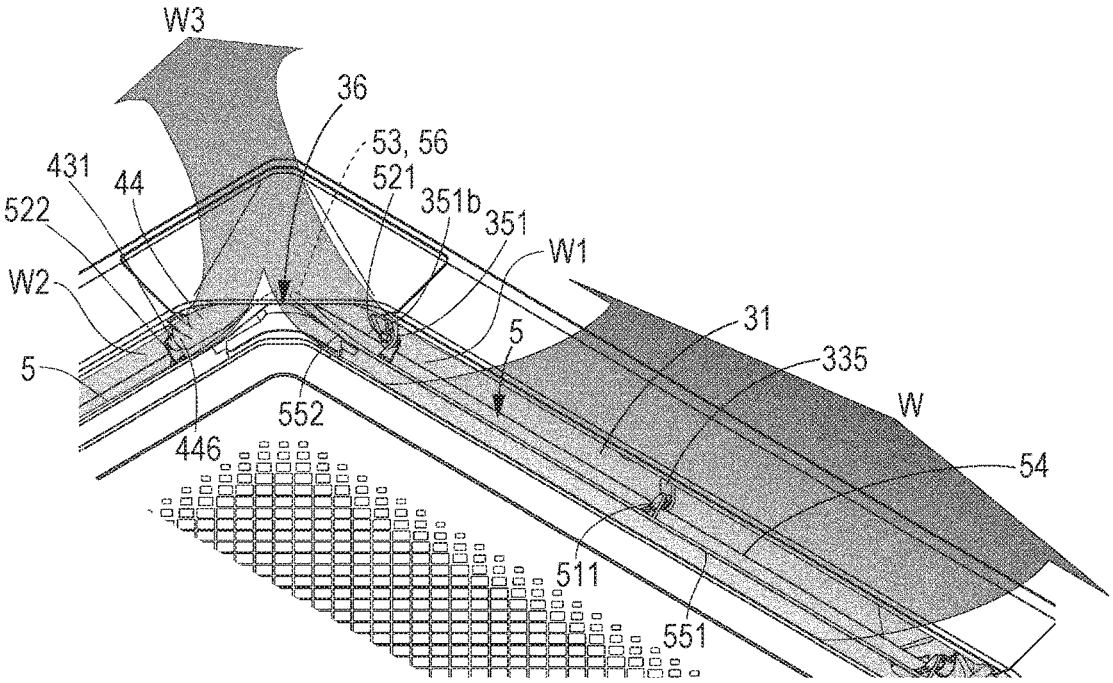
FIG. 12 is an illustrative view of the turning wind direction plate of the ceiling-embedded air conditioner.

The bearing surfaces 446 of the motor cover 44 are inclined to reduce interruption of the flow of the air W2 blown to the corner blowoff portion 36 as illustrated in FIG. 12.

Figure 11:
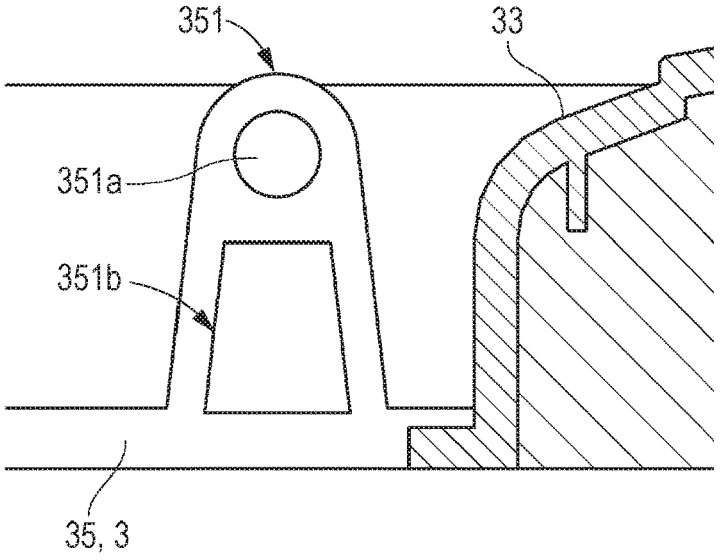
FIG. 11 is a cross-sectional view of FIG. 9 taken along line E-E, describing a bearing support column.

As illustrated in FIG. 11, the plate-like bearing support column 351 is erected from the connection portion 35 on the other blowoff opening 31 side. The bearing support column 351 has at the tip a shaft hole 351*a* to support pivotally the shaft portion 521 of the wind direction plate 5. The bearing support column 351 has a ventilation hole 351*b* as a hollow cavity between the shaft hole 351*a* and the connection portion 35.

The bearing support column 351 is provided with the ventilation hole 351*b* so that the air W1 passes through the ventilation hole 351*b* and moves toward the corner blowoff portion 36 as illustrated in FIG. 12. This makes the bearing support column 351 less prone to be resistance to the flow of the air W1. As a result, a large volume of air W1 can be guided to the corner blowoff portions 36. In addition, the bearing support column 351 is provided with the ventilation hole 351*b* to suppress occurrence of dew condensation due to a temperature difference between the surface of the bearing support column 351 on the blowoff opening 31 side and the surface of the bearing support column 351 on the corner blowoff portion 36 side. This eliminates the need to attach a heat insulator to the bearing support column 351.

Next, the effect of the turning of the decorative panel main body 30 formed by combining the components and the wind direction plates 5 will be described. First, while the air conditioner 1 is in the shutdown state, the four adjacent wind direction plates 5 cover the entire blowoff path 32 surrounding the suction grill 40 as illustrated in FIGS. 1 and 4. Accordingly, the wind direction plates 5 appear as being parallel to the decorative panel and the suction grill. This produces uniformity in design and improves designability.

Then, when the air conditioner 1 starts operation, the shaft portions 522 of the wind direction plates 5 supported pivotally by the bearing portions 431 of the motors 43 rotate as illustrated in FIG. 12. Accordingly, the shaft portions 511 supported pivotally by the bearing portions 335 and the shaft portions 521 supported pivotally by the bearing support columns 351 also rotate. In concert with the rotation, the first side portions 54 of the wind direction plates 5 turn toward the blowoff path 32. The wind direction plates 5 turn 60 degrees at maximum.

When the wind direction plates 5 turn, the first side portions 54 on the suction grill 40 side move into the blowoff path 32, and the third side portions 53 and the fourth side portions 56 slide into the corner blowoff portions 36. The portions of the second side portions 55 of the wind direction plates 5 protruding from the decorative panel main body 30 are only the straight portions 551 and the second arc portions 552. Accordingly, the end portions of the wind direction plates 5 do not appear projected. Accordingly, the wind direction plates 5 are less prominent even during operation. This provides a design with favorable appearance.

The air blown from the blowing fan 23 is guided to the wind direction portions 51 of the wind direction plates 5 through the blowoff openings 31, and is swiftly blown as the air W into the air-conditioned room K.

Meanwhile, also referring to FIG. 13, part of the blown air W is also blown by the rectifier plates 191 and 192 in the longitudinal direction of the blowoff openings 31. The airs W1 and W2 are guided by the rectifier plates 191 and 192 along the auxiliary wind direction portions 52 of the wind direction plates 5 to the corner blowoff portions 36 at the corners of the blowoff path 32.

There is no airflow resistance in the flow passages for the air W1 guided by the rectifier plates 191 in the directions of the bearing support columns 351. Accordingly, a large volume of air flows in the flow passages. The air W1 passes through the ventilation holes 351*b* of the bearing support columns 351 and reaches the corner blowoff portions 36. Meanwhile, the motor covers 44 constitute resistances in the flow passages for the air W2 guided by the rectifier plates 192. Accordingly, the air is less prone to flow in the flow passages as compared to the flow passages in the directions of the bearing support columns 351. In the embodiment, the bearing surfaces 446 of the motor covers 44 are inclined. This reduces interruption of flow of the air W2 and guides the air W2 to the corner blowoff portions 36.

The airs W1 and W2 join together at the corner blowoff portions 36. A larger volume of air flows in the flow passages for the air W1 as compared to the flow passages for the air W2. That is, the air W1 forms more powerful winds. Accordingly, the air W2 is taken in the blowing directions of the air W1. As illustrated in FIG. 13, the air W is blown from the blowoff openings 31. The winds of the air W3 formed by combining the airs W1 and W2 are blown with an inclination in the blowing directions of the air W1 relative to the diagonals D of the decorative panel 3. Accordingly, the air W3 is blown along the four sides of the decorative panel 3. That is, the air W3 is blown in four directions different from the blowing directions of the air W. As a result, the air conditioner 1 can send air in all directions to allow a wide room to be air-conditioned in an effective manner.

The expressions used herein for indicating shapes or states such as "square," "vertical," "parallel," "flush," "orthogonal," "center," and "all directions (omnidirectional)" refer to not only strict shapes or states but also approximate shapes or states different from the strict shapes or states without deviating from the influences and effects of the strict shapes or states.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A ceiling-embedded air conditioner comprising:

a box-shaped main unit that is adapted to be embedded in a ceiling of an air-conditioned room, and includes a blowing fan and a heat exchanger surrounding the blowing fan thereinside;

a square decorative panel that is mounted on a lower surface of the main unit and is adapted to cover the ceiling, the decorative panel including an outer frame portion, an inner frame portion disposed more inside than the outer frame portion, and connection portions connecting the outer frame portion and the inner frame portion at corner portions;

a blowoff path that extends along four sides of the decorative panel between the outer frame portion and the inner frame portion to be formed in a rectangular annular shape;

a blowoff opening that is an opening present between two connection portions adjacent to each other in the blowoff path;

a corner blowoff portion that is formed at each of the connection portions, and is included in the blowoff path with the blowoff opening; and a wind direction plate that is provided along each side of a square of the decorative panel to cover the blowoff path and is longer than a long side of the blowoff opening, wherein a part of conditioned air heat-exchanged with a refrigerant by the heat exchanger is blown from the blowoff opening at each side of the blowoff path to the air-conditioned room, and a remainder of the conditioned air is flown from the blowoff opening at each side of the blowoff path to the corner blowoff portion at each corner of the blowoff path, and blown from the corner blowoff portion at each corner of the blowoff path to the air-conditioned room, the wind direction plate includes a shaft portion, a plate-like bearing support column is erected from each of the connection portions, the bearing support column includes at a tip a shaft hole for supporting pivotally the shaft portion and includes a ventilation hole between the shaft hole and each of the connection portions, through which the conditioned air flowing from the blow off opening at each side of the blowoff path to the corner blowoff portion at each corner of the blowoff path passes, the main unit includes a main body blowoff opening at each side of a bottom surface, the connection portions connect upper portions of the outer frame portion and the inner frame portion at the corner portions, the blowoff opening is opened toward the main unit between the two connection portions adjacent to each other to communicate with the main body blowoff opening, and the corner blowoff portion is formed under each of the connection portions, and is covered with the wind direction plate from a lower side of the blow off path.

2. A ceiling-embedded air conditioner comprising:

a box-shaped main unit that is adapted to be embedded in a ceiling of an air-conditioned room, and includes a blowing fan and a heat exchanger surrounding the blowing fan thereinside;

a square decorative panel that is mounted on a lower surface of the main unit and is adapted to cover the ceiling, the decorative panel including an outer frame portion, an inner frame portion disposed more inside than the outer frame portion, and connection portions connecting the outer frame portion and the inner frame portion at corner portions;

a blowoff path that extends along four sides of the decorative panel between the outer frame portion and the inner frame portion to be formed in a rectangular annular shape;

a blowoff opening that is an opening between two connection portions adjacent to each other in the blowoff path;

a corner blowoff portion that is formed at each of the connection portions, and is included in the blowoff path with the blowoff opening;

a wind direction plate that is provided along each side of a square of the decorative panel to cover the blowoff path and is longer than a long side of the blowoff opening;

a motor;

a motor cover including a motor housing portion; and a shaft portion that is included in the wind direction plate and is pivotally supported and turned by a bearing portion of the motor, wherein a part of conditioned air heat-exchanged with a refrigerant by the heat exchanger is blown from the blowoff opening at each side of the blowoff path to the air-conditioned room, and a remainder of the conditioned air is flown from the blowoff opening at each side of the blowoff path to the corner blowoff portion at each corner of the blowoff path, and blown from the corner blowoff portion at each corner of the blowoff path to the air-conditioned room, the motor is housed in the motor housing portion of the motor cover and is fixed to each of the connection portions together with the motor cover from a front surface side of the decorative panel, the motor housing portion includes a bearing surface surrounding the bearing portion on a blowoff opening side, the bearing surface inclines from a peak of the motor housing portion toward the blowoff opening so that the remainder of the conditioned air is flown to the corner blowoff portion at each corner of the blowoff path along the bearing surface, the main unit includes a main body blowoff opening at each side of a bottom surface, the connection portions connect upper portions of the outer frame portion and the inner frame portion at the corner portions, the blowoff opening is opened toward the main unit between the two connection portions adjacent to each other to communicate with the main body blowoff opening, and the corner blowoff portion is formed under each of the connection portions, and is covered with the wind direction plate from a lower side of the blow off path.

3. The ceiling-embedded air conditioner according to claim 1, wherein the wind direction plate includes a wind direction portion covering the lower side of the blow off path opposed to the blowoff opening, and an auxiliary wind direction portion positioned at each end of the wind direction portion and covering the corner blowoff portion, and the main unit further includes a rectifier plate arranged at the main body blowoff opening and including a curved surface to flow the conditioned air to the bearing support column.

4. The ceiling-embedded air conditioner according to claim 2, further comprising a panel heat insulating member arranged at each side of the blowoff path, wherein the motor cover further includes a bottom path formed adjacent to the motor housing portion to be attached to each of the connection portions, a lock portion arranged at a side of the outer frame portion to engage the decorative panel, a wall surface arranged at a side of the inner frame portion, and a rib arranged inside the wall surface to house a part of the panel heat insulating member between the wall surface and the rib, and the bearing surface includes a first inclined portion formed between the bearing portion and the lock portion, and a second inclined portion formed between the bearing portion and the bottom path.

5. The ceiling-embedded air conditioner according to claim 2, wherein the wind direction plate includes a wind direction portion covering the lower side of the blow off path opposed to the blowoff opening, and an auxiliary wind direction portion positioned at each end of the wind direction portion and covering the corner blowoff portion, and the main unit further includes a rectifier plate arranged at the main body blowoff opening and including a curved surface to flow the conditioned air to the motor cover.

* * * * *